US007840332B2

(12) United States Patent
Saravanapriyan et al.

(10) Patent No.: US 7,840,332 B2
(45) Date of Patent: Nov. 23, 2010

(54) SYSTEMS AND METHODS FOR STEAM TURBINE REMOTE MONITORING, DIAGNOSIS AND BENCHMARKING

(75) Inventors: Arul Saravanapriyan, Bangalore (IN); Vivek Venugopal Badami, Schenectady, NY (US); Vinay Bhaskar Jammu, Bangalore (IN); Jitendra Kumar, Mableton, GA (US); Abhay Sudhakar Rao Kant, Dubai (AE); Mahalakshmi Shunmugam Balasubramaniam, Bangalore (IN)

(73) Assignee: General Electric Company, Niskayuna, NY (US)

( * ) Notice: Subject to any disclaimer, the term of this patent is extended or adjusted under 35 U.S.C. 154(b) by 838 days.

(21) Appl. No.: 11/712,144

(22) Filed: Feb. 28, 2007

(65) Prior Publication Data

US 2008/0208429 A1 Aug. 28, 2008

(51) Int. Cl.
*G06F 19/00* (2006.01)

(52) U.S. Cl. ..... 701/100

(58) Field of Classification Search ..... 701/99–100, 701/29; 702/182; 700/286–290
See application file for complete search history.

(56) References Cited

U.S. PATENT DOCUMENTS

| | | | | |
|---|---|---|---|---|
| 4,115,998 | A * | 9/1978 | Gilbert et al. | 60/39.091 |
| 4,410,950 | A | 10/1983 | Toyoda et al. | 364/551 |
| 4,455,820 | A * | 6/1984 | Buckley et al. | 60/773 |
| 5,794,446 | A | 8/1998 | Earley et al. | 60/646 |
| 6,195,607 | B1 * | 2/2001 | Rajamani et al. | 701/100 |
| 6,625,987 | B2 * | 9/2003 | Pisano et al. | 60/773 |
| 6,671,647 | B2 | 12/2003 | Ishii et al. | 702/136 |
| 6,853,959 | B2 | 2/2005 | Ikeda et al. | 702/188 |
| 6,868,368 | B1 | 3/2005 | Lang | 702/188 |
| 7,188,019 | B2 * | 3/2007 | Nomura et al. | 701/100 |
| 7,260,466 | B2 * | 8/2007 | Fujii | 701/100 |
| 2004/0010387 | A1 | 1/2004 | Girbig | 702/113 |

FOREIGN PATENT DOCUMENTS

| | | |
|---|---|---|
| EP | 1 113 366 A2 | 7/2001 |
| EP | 0 944 768 B1 | 11/2002 |

* cited by examiner

*Primary Examiner*—Yonel Beaulieu
(74) *Attorney, Agent, or Firm*—Ann M. Agosti

(57) ABSTRACT

Systems and methods for steam turbine remote monitoring, calculating corrected efficiency, monitoring performance degradation, diagnosing and benchmarking are disclosed with an example turbine system including a turbine, a data acquisition device coupled to the turbine, the data acquisition device for collecting turbine data that includes performance parameters of the turbine and a central monitoring system coupled to the data acquisition device, the central monitoring system for receiving the collected turbine data and processing the turbine data to determine turbine performance.

34 Claims, 9 Drawing Sheets

SYSTEMS AND METHODS FOR STEAM TURBINE REMOTE MONITORING, DIAGNOSIS AND BENCHMARKING

BACKGROUND

The present disclosure generally relates to steam turbines and more particularly to systems and methods for steam turbine remote monitoring, calculating corrected efficiency, monitoring performance degradation, diagnosing and benchmarking.

Monitoring steam turbine efficiency is critical for performance and cost effectiveness. Steam turbine performance is monitored at test conditions during initial performance evaluation and commissioning checks. This performance monitoring is often carried out with the help of precision sensors specially mounted in specific locations to give more accurate readings of sensor data. Performance monitoring of a steam turbine can be repeated at regular intervals using measured data or time-based methods. Determining the thermal performance on a continuous basis is important for improving plant heat rate because it provides the ability to track changes due to day-to-day events such as operational variations. Thermal performance for fossil fueled power plants depends on boiler efficiency and turbine cycle performance.

When steam turbines are installed and delivered, thermal performance tests are conducted using precision sensors to demonstrate if the equipment satisfies contractual requirements. Additional tests are conducted periodically at different operating intervals to check for any performance shortfalls. After installation and delivery, plant performance tools calculate the deviations between current or actual efficiency of the equipment. In general, the expected performance at rated conditions using industry standards (ISO, ASME PTC, DIN etc) are implemented as performance monitoring guidelines. The deviations between actual and expected performance data are used to monitor short- and long-term equipment degradation and can be used to make service recommendations to improve turbine performance. All the above tests are conducted during special test periods and are not performed during routine operation of the turbine.

For the tests discussed above, the unit must be operated at specified conditions within allowable operational variation bands. Any additional efficiency measurement tests typically require expensive instrumentation and restrict operational flexibility. Hence, using the above-described methods, it is not possible to trend unit efficiency.

Furthermore, turbine failures can result in large economic losses. Presently, individual steam turbines are monitored for only critical performance parameters using field sensor data providing general health statistics. In general, there is no way to determine in-depth operational characteristics and compare or baseline a unit's performance with respect to the other units of the same configuration or design type. Although analyzing a single unit's performance can provide insight into a steam turbine's actual performance, the monitoring and diagnostics center typically needs additional information across the installed fleet to troubleshoot performance degradation issues related to a particular design type or configuration to assist in validation of new steam turbine designs, and provide feedback to the design engineering group.

Therefore, systems and methods are needed not only to continuously evaluate steam turbines but also to baseline a unit's performance on a fleet and determine the source of operational deviations, such as particular design type and operational anomaly.

BRIEF DESCRIPTION

Disclosed herein is a turbine system, including a turbine, a data acquisition device coupled to the turbine, the data acquisition device for collecting turbine data that includes performance parameters of the turbine and a central monitoring system coupled to the data acquisition device, the central monitoring system for receiving the collected turbine data and processing the turbine data to determine turbine performance.

Additional embodiments include a turbine performance measurement method, including acquiring data real-time from a turbine, transmitting the data at periodic intervals for analysis, analyzing the transmitted data for operating parameters and applying the analyzed data to the turbine to alter performance of the turbine.

Further disclosed herein is a turbine performance monitoring system, including a data acquisition device for acquiring data from a turbine, a server for receiving acquired data from the data acquisition device, a communication medium disposed between the data acquisition device and the server, a storage medium coupled to the server, the storage medium having performance processes for processing the acquired data and a graphical user interface coupled to the processes for presentation and display of the processed data.

BRIEF DESCRIPTION OF THE DRAWINGS

The disclosure and embodiments thereof will become apparent from the following description and the appended drawings, in which the like elements are numbered alike.

DETAILED DESCRIPTION

Figure 1:
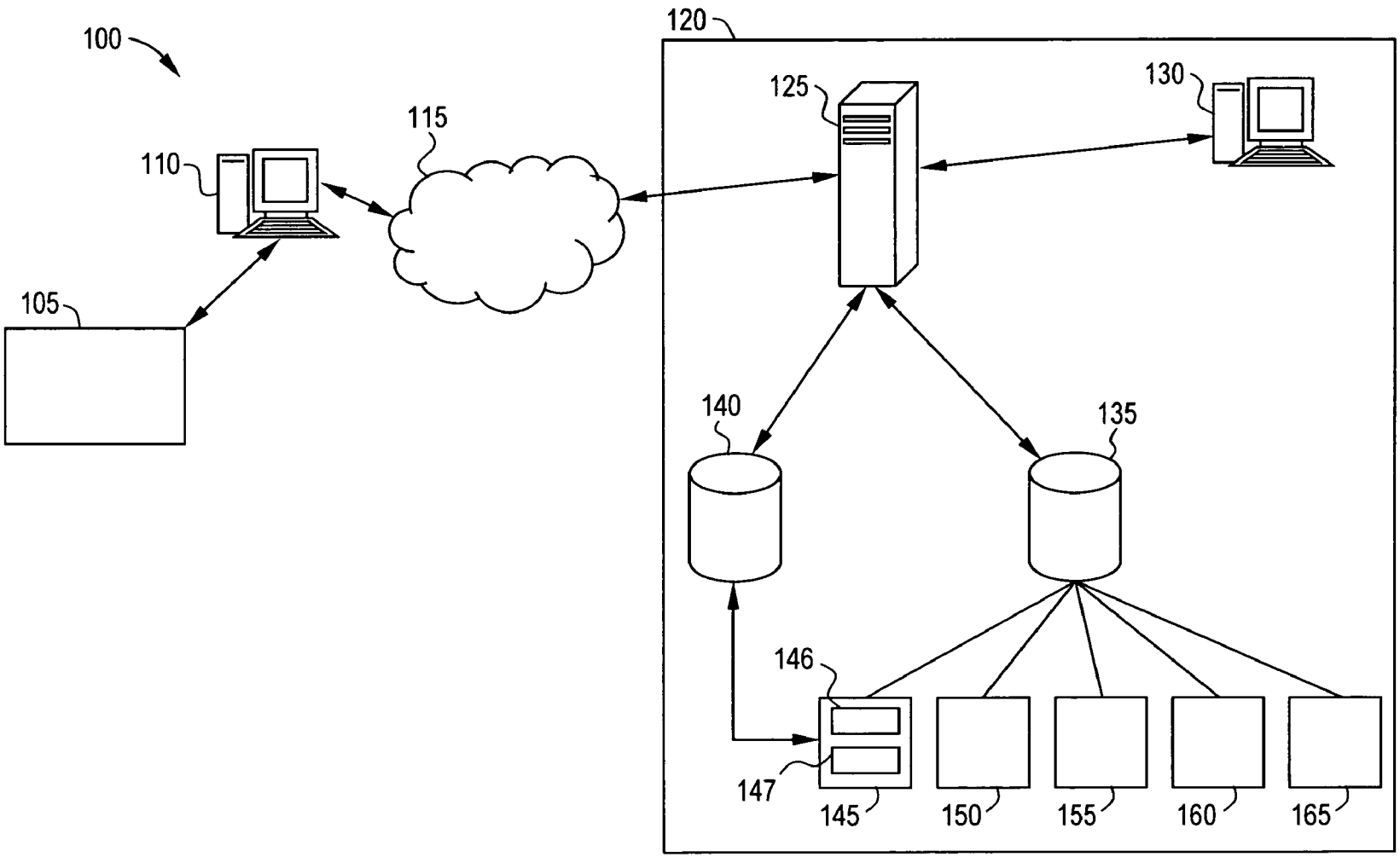
FIG. 1 illustrates an exemplary embodiment of a steam turbine remote monitoring, diagnosing and benchmarking system.

Exemplary embodiments provide the ability to continuously evaluate the degradation of turbine equipment due to mechanical problems such as, but not limited to: wear, deposits, oxidation, etc., and to suggest ways to improve performance to optimize plant operation. Trending accurate efficiency values using low cost station sensors during normal operation of the unit is provided. Furthermore, trending can be used to detect operational anomalies and degradation of the unit over time to improve on operational flexibility and cost effectiveness. In accordance with exemplary embodiments, systems and methods receive inputs from station sensors and calculate efficiency values in real time. During operation, efficiency corrections for deviations from rated specifications are also performed over time. The calculated section efficiency points are corrected for valve opening, throttle temperature, pressure, etc., to account for offsets from rated specifications. As such, a corrected efficiency value can be calculated in real time. This methodology enables plotting the corrected efficiency values as a trend. Specific operational anomalies can be detected by monitoring the trending of the corrected efficiency. Corrective actions can be initiated thereby improving operational flexibility and cost effectiveness.

Exemplary embodiments further provide the capability to monitor an entire steam turbine fleet for health and performance, and to study steam turbine unit-to-unit and fleet-to-fleet variations. "Fleet Metrics" of steam turbines provide data and information about overall operation profile of a unit by monitoring various normal and abnormal events during entire operating life of the unit. Various normal and exception events, such as starts and stops, vibration and temperature exceedances, etc. are detected during the operation of a steam turbine, and a comprehensive summary of unit operation profile is prepared. This analysis is further used to determine lifing and various anomalies detected during the operation of steam turbine. In one exemplary implementation, the system tracks fleet lifing and usage metrics for all the steam turbines that are being monitored. These metrics include, but are not limited to: hot starts; cold starts; starts/stops/trips; hours of operation; hours of down time; hours on turning gear; hours the inlet temperature exceeded pre-defined thresholds; hours the exhaust pressure exceeded pre-defined thresholds; hours at different load levels; hours at different operating modes, etc. In other exemplary implementations, the system provides exception events monitoring. The system provides capability to determine if the monitored unit is in, or is heading toward an undesirable (i.e., anomalous) condition (e.g., higher than expected vibration or temperature levels, or significant performance deviation from expected values). The system provides capability to detect anomalies that occur in the time frame between seconds to hours to integrate with the diagnostic system for diagnosis. In still other exemplary implementations, the system provides benchmarking units. The system provides capability to calculate and do comparative analyses of various critical parameters by using baselining or benchmarking. Baselining and benchmarking both refer to comparing a particular unit's performance or a critical parameter against a representative sample of similar units. The system also provides capability to compare current sensor values or calculated values against their values taken during commissioning and other special events. The baseline data resides in the central system, and is available for the life of the machine for future analysis.

FIG. 1 illustrates an exemplary embodiment of a steam turbine remote monitoring, diagnosing and benchmarking system 100. In general, system 100 includes steam turbine facility 105 coupled to and in communication with on-site data acquisition device 110, which can be a computer, used for steam turbine data acquisition and storage. Data acquisition device 110 can be other devices including, but not limited to: desk top computer, lap top computer, portable computing device (e.g., a personal digital assistant), etc. System 100 provides the capability to perform real time efficiency analysis on the data collected by the data acquisition device 110. Data acquisition device 110 is coupled to a communication medium 115 such as a network, which can be an internet protocol (IP) based network that transmits turbine data from data acquisition device 110 to central monitoring station 120, which is discussed further in the description below. In exemplary embodiments, communication medium 115 is a managed IP network administered by a service provider, which can control bandwidth and quality of service for data streams. Communication medium 115 may be implemented in a wireless fashion, e.g., using wireless protocols and technologies, such as WiFi, WiMax, etc.

System 100 further includes central monitoring station 120, which provides monitoring and diagnosing of a fleet of turbines. Therefore, fleet wide performance and diagnosis of steam turbines can be determined. Central monitoring station 120 can further include steam turbine server 125, which can further be coupled and in communication with work station 130. Work station 130 can include a graphical user interface (GUI) for coordinating monitoring and diagnosing of steam turbine facility 105. In general, the GUI User displays significant plots and tables of performance results.

Server 125 can further include storage medium 135 and steam turbine database 140. Several processes 145, 150, 155, 160, 165 can reside in storage medium 135. A data retrieval and archiving process 150 retrieves data collected from the steam turbine facility 105, organizes file structures, and appropriately archives the data. A diagnostic assessment process 155 provides necessary diagnostic algorithms used to test the performance and health of the steam turbine fleet. A data calculations process 160 provides any further data calculations necessary for monitoring and diagnosing steam turbine facility 105. A data visualization and reporting process 165 provides the user with charts, graphs and other data visualization tools to analyze and report data and any diagnostic information related to steam turbine facility 105. The data visualization can be presented on the GUI on workstation 130. A calculation engine process 145, which can include a data validation sub-process 146 and algorithms sub-process 147, is coupled to and interfaces with steam turbine database 140. Calculation engine process 145 validates the real time data and executes the diagnostics algorithms. Calculation engine process 145 can provide direct interface with the GUI on workstation 130.

It is appreciated that system 100 can implement methods in accordance with exemplary embodiments. In one embodiment, system 100 can implement a corrected efficiency method, which can include monitoring performance degradation of steam turbines. In another embodiment, system 100 can implement a thermal performance metrics method for both a single turbine and a fleet of turbines. In still another embodiment, system 100 can implement a vibration metrics method for both a single turbine and a fleet of turbines. In yet another embodiment, system 100 can implement a expended life method. In still another embodiment, system 100 can implement a method to calculate multiple critical performance metrics such as those performance metrics discussed above. In another embodiment, system 100 can implement a backpressure monitoring method for a single turbine or a fleet of turbines. In another embodiment, system 100 can implement a benchmarking stem turbine fleet performance method. The methods are now described in further detail. It is understood that in other embodiments and implementations, system 100 can implement other methods related to steam turbine monitoring, diagnosing, etc.

In one embodiment, system 100 provides the ability to calculate efficiency using station sensors, make corrections for off spec operating conditions of the unit and trend the values. System 100 monitors real time steam turbine unit performance online which allows operators to understand steam turbine facility 105 performance over time and further allows operators to diagnose and repair any faults. System 100 provides a comprehensive, uniform, real-time infrastructure to collect, process, and display section performance and trends from remote test sites.

In exemplary implementations, system 100 can acquire real time data at sampling intervals (e.g., 1-minute) from data acquisition device 110 and use the data to monitor the steam turbine parameters. As discussed further below, system 100 can provide the following parameters: calculation of the high pressure (HP) efficiency using station sensors; data validation techniques to use such data for efficiency calculation method; optimized stability criteria conditions; online method of efficiency calculation; calculation of correction factors for valve opening and throttle temperature; filtering rules to reduce performance scatter due to valve opening and throttle temperature; usage of performance curves to estimate unit degradation, etc.

Figure 2A:
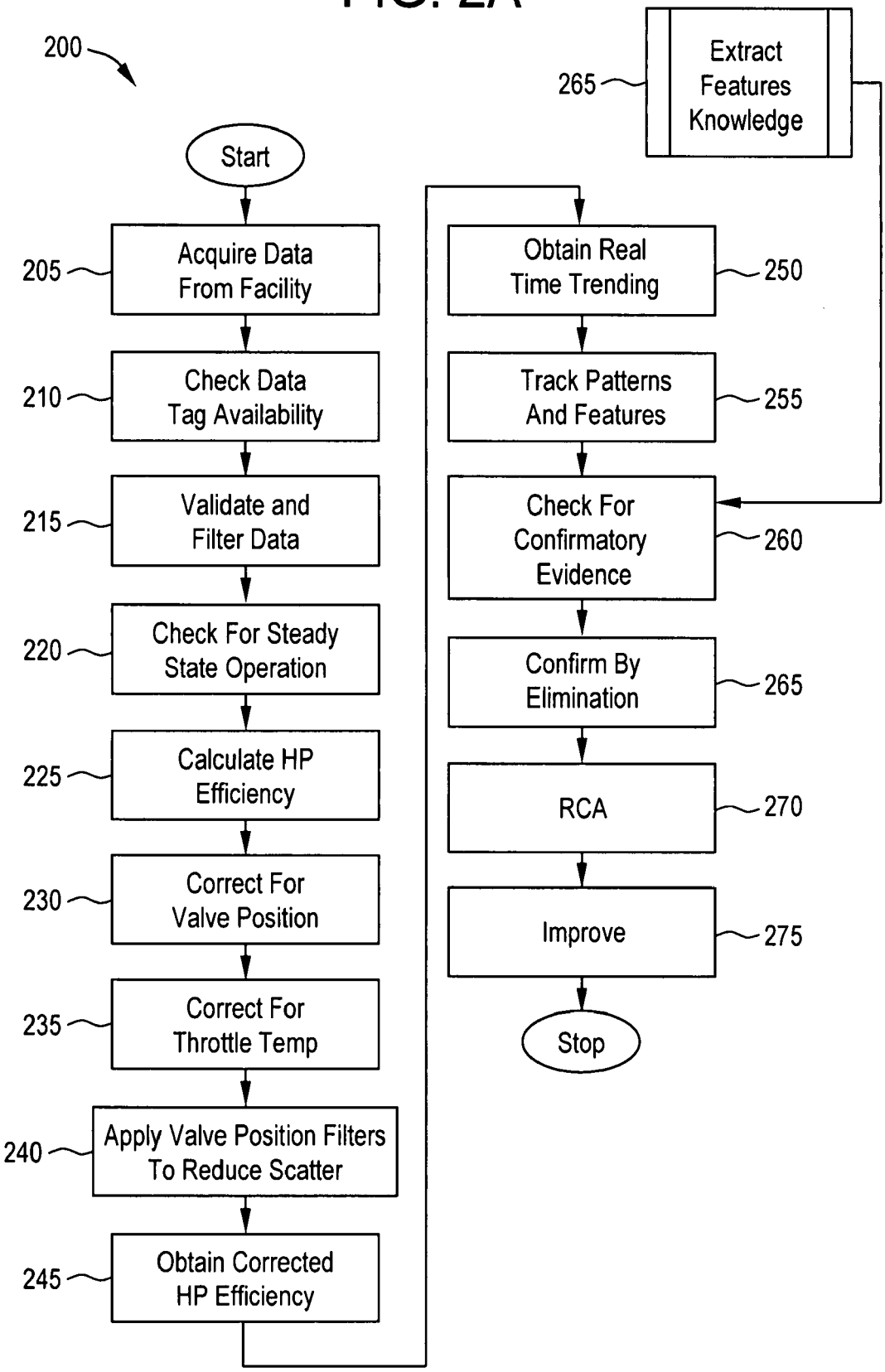
FIG. 2A illustrates of flow diagram of an exemplary HP efficiency and HP efficiency correction method.

FIG. 2A illustrates a flow diagram of an exemplary method 200 that can be implemented in the steam turbine remote monitoring, diagnosing and benchmarking system 100. As discussed above, steam turbine online performance monitoring calculation procedures use the acquired data from data acquisition device 110, which can be at a sampling condition of 1-minute interval. Therefore, at step 205, the system 100 acquires data from steam turbine facility 105. At step 210, data tag availability is performed and data values from specific tags are taken. Data tags can include, but are not limited to: Inlet Pressure (IP); Inlet Temperature (IT); Outlet Pressure (OP); Outlet Temperature (OT), etc.

At step 215, the data is validated and filtered. In general, the data is checked for accuracy. Sensor and measurement system malfunctions are also validated to eliminate faulty data inputs. The values undergo a specific set of rules that check for data validity of the raw data. Checking of data validity conditions is implemented in order to eliminate unwanted data sets. Checking of data validity also helps in reducing false calculations and addresses off-unit operation from off-spec conditions. Erratic behavior of sensors often results into poor data quality (outliers). In such conditions, lack of data quality checks in the efficiency calculation algorithm leads to large variations in the calculated efficiency rendering these values unbelievable. To overcome those issues, data quality algorithms are used to eliminate the unwanted data sets. In an exemplary implementation, the rule set includes, but is not limited to: Rate of change of DWATT (load)<=3 MW; Rate of change of IP_P (Inlet Steam Pressure for HP Section)<=10 psig; Rate of change of HRHP_P (Hot Reheat Steam Pressure for HP Section)<=5 psig; Rate of change of V1_POS (Valve Position)<=5%; Standard Deviation for IP_P<=20 psig in the block; Standard Deviation for HRHP_P<=10 psig in the block; Standard Deviation for TT_IS<=5 deg F. in the block; Stdev for HRHP_P<=5 deg F. in the block, etc These rule sets are framed based on the guidelines provided by PES (Performance Evaluation Services) to perform Enthalpy-Drop test (ASME PTC 6.0S procedures). This test reduces the parameter variance in calculation block and in turn reduces the variance in the calculated efficiency.

In accordance with exemplary embodiments, the data validation techniques involve static range checking of input data used for section efficiency calculation to test data against minimum and maximum values where the power output is more than 85% of the rated load in order to detect and reject data from failed sensors. Dynamic range checking can also be used to detect sensor drifts, which produces the expected value of the sensor. In general, ranges used to detect sensor drifts are calculated from a predetermined model. If more than one data value is available for a single quantity such as turbine stage pressure or temperature, the data is averaged to improve both precision and reliability of the measured data. If a particular sensor is not available, it is mapped to an available sensor, which can be substituted for that measurement. An example of a measurement is a reheater drop factor used to infer cold reheat pressure from hot reheat pressure values. The reheater drop factor is unit dependent and is evaluated from an initial enthalpy-drop test (discussed further in the description below). Once the cold reheat pressure is calculated then HP inlet pressure and temperature and cold reheat pressure and temperature are used to calculate the HP efficiency. In exemplary implementations, the HP exhaust steam temperature is used for calculation. In other exemplary implementations, where there is no exhaust temperature sensor, the exhaust metal temperature is used for the efficiency calculation.

Once these values pass validity criterion, these data values are checked for stability conditions at step 220. In this step, various unit operation stages are calculated and the data is checked for various stability conditions. For example, an enthalpy-drop test as per ASME PTC 6.0S procedures is performed under controlled conditions of HP inlet pressure, valve position (valve fully open) and DWATT. In general, it is appreciated that units operate under different operating conditions depending on customer requirements. Therefore, for real time performance trending (as discussed further below at step 250), unit-operating conditions, where conditions are stable for HP efficiency calculations, are determined. These stability conditions are established using the stability conditions used during testing as per ASME PTC 6.0S procedures.

The stability conditions are evaluated for a set time period, for example, every 30 continuous minutes of operation. In exemplary implementations, sample block sizes are chosen, such as in blocks of 30 samples. The selection of sample block sizes for data acquisition aids in reducing the parameter (IP_P, HRHP_P, DWATT, TT_IS (HP section Inlet Steam Temperature) and TT_ES (HP Exhaust Steam Temperature) variance in the block and in turn reduces the HP efficiency variance. Initial bases for steady state determination criteria can be determined from enthalpy drop test conditions and steam condition variations during tests. Thereafter, these criteria can be optimized by performing a Design Of Experiment (DOE) and optimization experiment using six-sigma tools. Specific threshold values for rules used to determine stability and rate of change of data is posed as a multi-objective constrained optimization problem. Multiple objectives to minimize the variation in the efficiency estimate while maintaining at least a minimum set of data points in the estimate and constraining the threshold values to be in specific regions of engineering feasibility is setup. A design of experiments is performed using field data to develop transfer functions relating variations in the stability and rate of change rules to variation in efficiency and the minimum number of points in each estimate. These transfer functions are then used by the optimization algorithms such as gradient descent algorithms, genetic algorithms to identify the optimum values of thresholds for stability and rate of change rules. The stability criteria rules that are outcome of the optimization process, as discussed above, are: Rule 1, Rate of change of DWATT<=3 MW; Rule 2, Rate of change of IP_P<=10 psig; Rule 3, Rate of change of HRHP_P<=5 psig; Rule 4, Rate of change of V1_POS<=5%; Rule 5, Block size of data to consider for averaging=30 minutes block; Rule 6, Stdev for IP_P<=20 psig in the block; Rule 7, Stdev for HRHP_P<=10 psig in the block; Rule 8, Stdev for TT_IS<=5° F. (−15°) in the block; and Rule 9, Stdev for HRHP_P<=5° F. (−15°) in the block.

At step 225, once the aforementioned these steps are completed satisfactorily, using the data that has passed the data quality checks, validity checks and stability checks, efficiency of the HP section is calculated using an enthalpy drop method. HP efficiency is the ratio of the actual enthalpy drop to the isentropic enthalpy drop across an inlet and an exhaust of a high-pressure section of a given steam turbine. Efficiency is displayed in units of percent. Therefore, HP section efficiency is calculated, using the standard isentropic formula, as follows:

$$\text{HP Section Efficiency}=(\text{Enthalpy}_{inlet}-\text{Enthalpy}_{exhaust})/\text{Isentropic enthalpy drop},$$

where $\text{Enthalpy}_{inlet}$=f (inlet temperature, inlet pressure), and $\text{Enthalpy}_{outlet}$=f (exhaust temperature, exhaust pressure)

At step 230, the above-calculated efficiency is then corrected for off spec operation of the unit. This calculated value is corrected by calculating a valve opening factor and a throttle temperature factor. The method to calculate these factors is now discussed.

These calculations are needed to make adjustments to the efficiency calculation described above. Although several precautions are taken to ensure the data is good and steam turbine is in stable condition, further adjustments can be performed to ensure accurate estimates of efficiency. For example, a valve correction algorithm accounts difference in steam turbine design due to the way the steam values operate (e.g., full arc or partial arc). In an exemplary implementation, to represent the HP efficiency of the HP Section, valve correction is performed on the calculated isentropic efficiency. Unit operation is classified as full arc or partial arc based on valve position rules. Based on arc classification, the correct HP efficiency correction multiplier for valve opening is used.

At step 235, the above-calculated efficiency is also corrected by calculating the corrected efficiency point for valve opening for changes in average throttle temperature (TT_IS) from the rated temperature, as follows:

Calculate difference of temperature from rated condition: $DT=(TT_IS-\text{Treated})$ Calculate change in efficiency: $\%\ HPEFF=(-0.55/50*DT)$ Calculate HP Efficiency correction factor: $CF=1/(1+\%\ HPEFF)$ The above calculations provide correction factor (CF) for variations in throttle temperature from the rated temperature during efficiency calculations. First, the difference between average throttle temperature and rated throttle temperature ($T_{rate}$) is calculated. Then using the empirical calculations, a correction factor (CF) is calculated and used to correct efficiency calculations made previously.

In general, to carry out throttle pressure correction calculations, several filters are considered. The following filters are used to reduce scatter of the corrected efficiency points: Start/Stop filter; control valve position filter; and throttle temperature filter.

For the Start/Stop filter, if the calculated HP efficiency point is close to a start or stop event, then variation of HP efficiency may be due to unstable steam conditions during Starts/Stops transient events. For example, to avoid process variations, the HP efficiency algorithm filters out HP efficiency points at a time period defined by 5 hrs after any Start events and 3 hrs before the Stop events. The correction time periods are arrived through statistical means to ensure that any thermal transients due to starts and stops are not affecting the accuracy of the efficiency calculation.

For the control valve position filter, the data based on a fixed control valve position (e.g., CV#4), is filtered. Therefore, a performance parameter can be trended over time for a fixed valve position (e.g., 20.5%). The valve position to be trended may vary depending on the frequency of turbine operation at a specific valve position.

For the throttle temperature filter, the plotted data has a target throttle temperature within the range of +/−10° F. (−12° C.) of rated temperature (i.e. (Rated−10° F. (−23° C.))< TT_IS<(Rated+10° F. (−12° C.))). In cases where the average throttle temperature is significantly different from the rated temperature, the "average" operating temperature may be substituted for the rated temperature.

At step 240, the valve position filters are applied to reduce scatter as of the corrected efficiency points as discussed above. In general, the HP isentropic efficiency calculation does not address partial arc/full admission operation. Isentropic HP Efficiency is corrected for valve opening using HP Efficiency Correction Multiplier Transfer Function. This HP Efficiency Correction Multiplier is derived from Valve CamCalc design data for that particular unit and test HP Efficiency vs. Flow Ratio (for a particular unit) look-up tables. Valve CamCalc Design data is look-up table of Valve Position vs. Flow Ratio Rate. In general, HP Efficiency Correction Multiplier=f(Isentropic HP Efficiency, HP Control Valve position at Isentropic HP Efficiency calculation period).

At step 245, the corrected efficiency is then obtained and the corrected efficiency value can be plotted over time as a trend at step 250. The real time trending is used to detect various specific operation anomalies and unit degradation conditions.

At step 255, system 100 can be used to track patterns and features of system 100. The estimation algorithm calculates HP efficiency on a continuous basis under steady state operating conditions. Any shortfall in performance degradation is then calculated from a start based on the difference between expected and current values of the performance parameters. Degradation plots can then be used to study when and how the equipment has degraded, and to study the causes of degradation At step 265, features of the turbines can be pre-determined. Therefore, system 100 can be provided with knowledge of about the turbine that can be used to check for confirmatory evidence at step 260 based on the tracked patterns and features at step 255. The following specific performance parameters are calculated to monitor the unit performance: section enthalpy drop efficiency; corrected efficiency; section pressure ratios; section temperature ratios; section temperature drops; corrected first stage pressure; axial displacement; HP first stage flow constant, etc. These features are used to calculate and co-relate the performance degradation with various detectable anomalies. At step 265, further confirmation can be obtained by eliminating any factors or evidence that is inconsistent with the extracted features. In general, it is appreciated that the following anomalies can be detected by using efficiency trending as described: erosion/corrosion; deposition; erosion; seal wear; leakage; thermal degradation; unit operation, etc.

At step 270, root cause analysis (RCA) is performed. RCA is the analysis carried out to identify/track the initiating cause for a failure/success. Whenever there is a change in efficiency trend, RCA is performed to identify the cause and to advise the customer on the action to be taken to correct the situation.

At step 275, improvements to the system 100 are made based on the data gathered in the above-described steps.

Figure 2B:
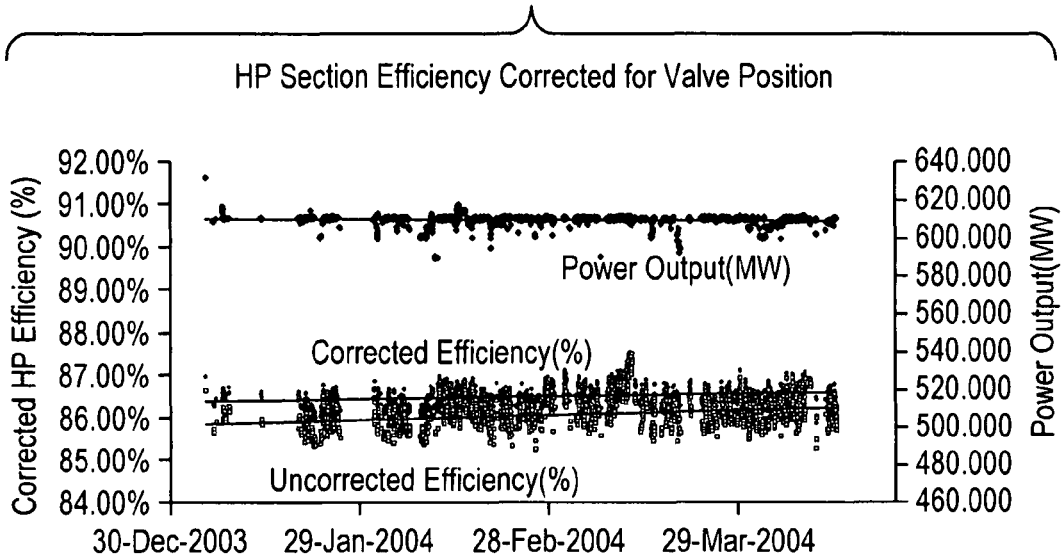
FIG. 2B illustrates a plot illustrating HP section efficiency corrected for valve position, and a plot of HP section corrected efficiency vs. valve position, in accordance with exemplary embodiments.
Figure 2B:
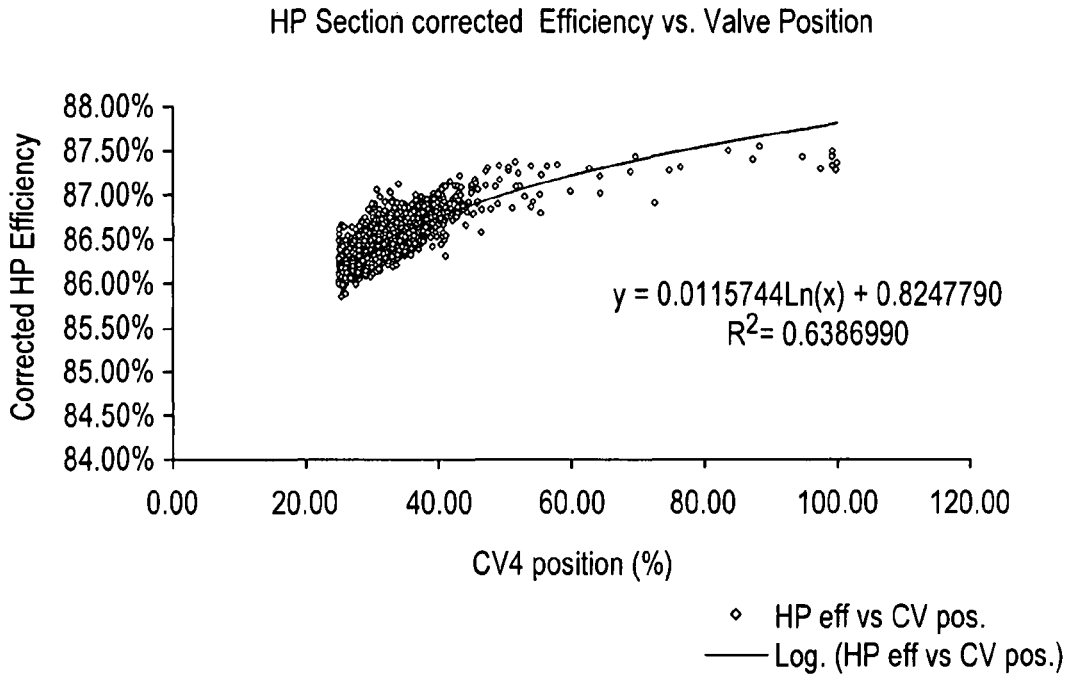
Figure 2C:
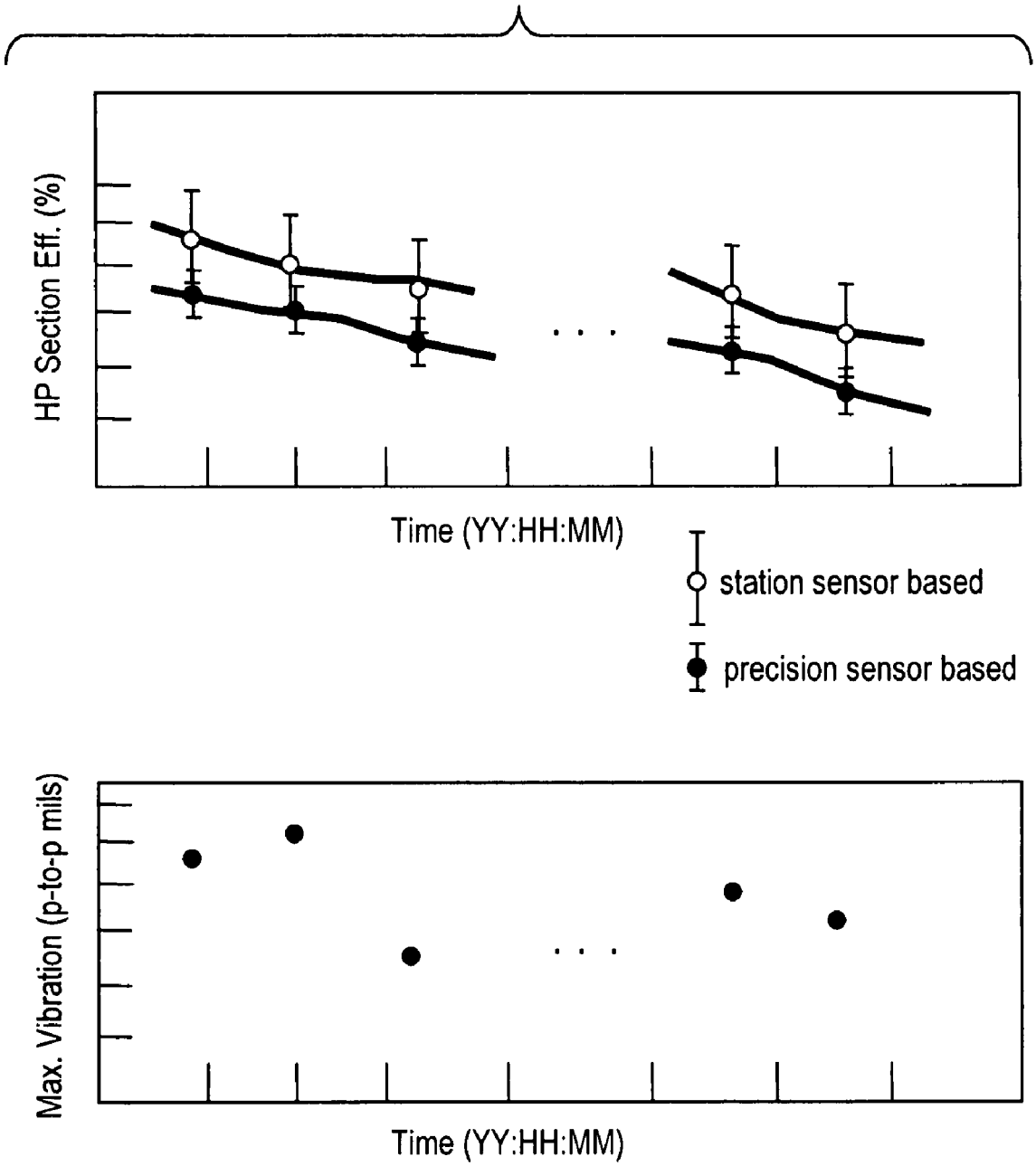
FIG. 2C illustrates a first exemplary plot of HP section efficiency versus time and a second exemplary plot of vibration events versus time.

FIG. 2B illustrates a plot illustrating HP section efficiency corrected for valve position, and a plot of HP section corrected efficiency vs. valve position, in accordance with exemplary embodiments. FIG. 2C illustrates a first exemplary plot of HP section efficiency versus time and a second exemplary plot of vibration events versus time. The top graph provides both efficiency estimates using station sensors and precision sensors (when available), with a statistical confidence interval around each of the points. Changes in efficiency can now be more accurately identified since the variation bands for precision instruments are similar in width to results from station sensors. These results could be further correlated with other operational anomalies such as vibration events, rub events, etc. A further discussion of vibration metrics is provided in the description below.

Figure 3:
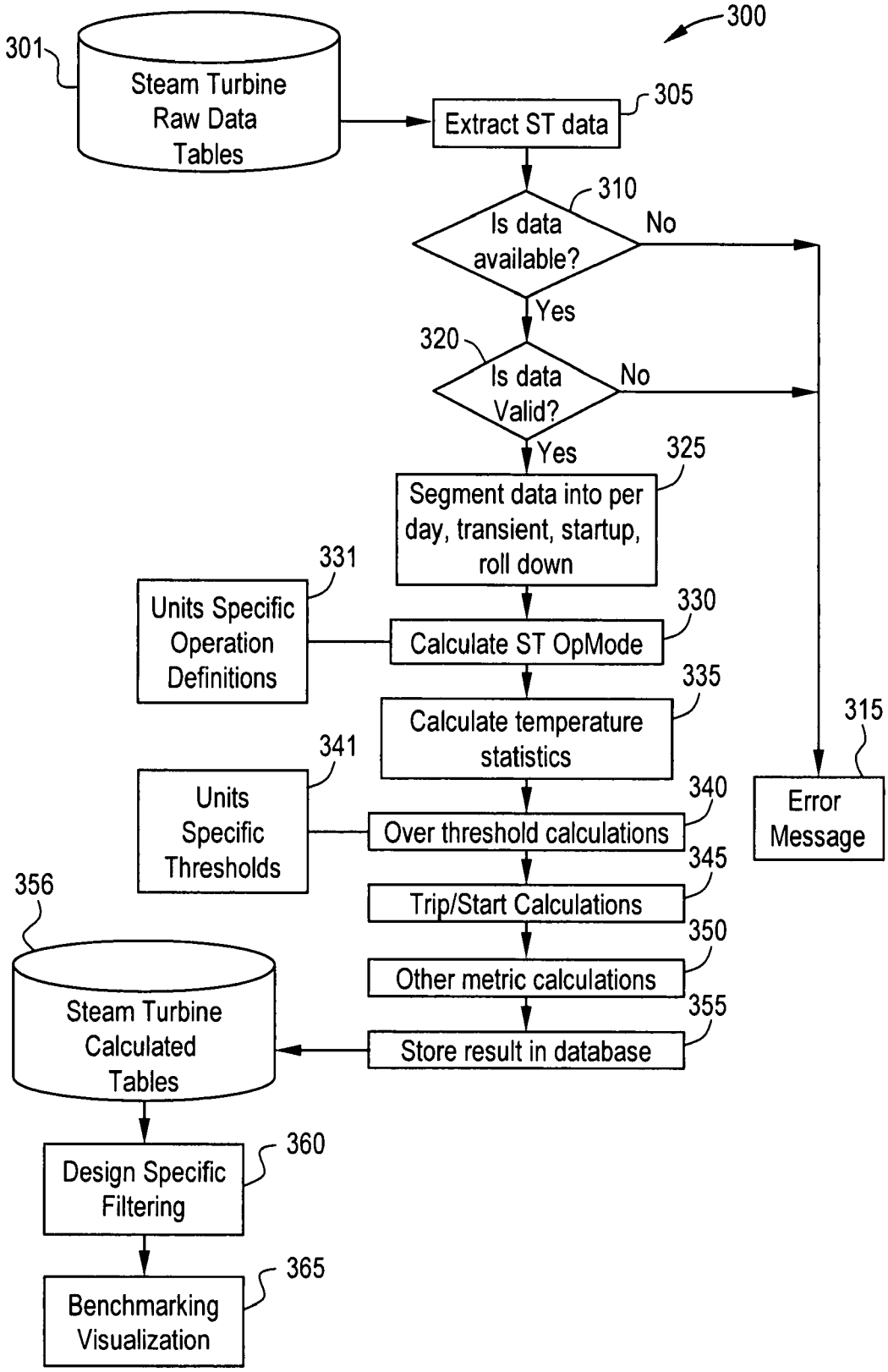
FIG. 3 illustrates a flow diagram of an exemplary thermal performance metrics calculation method.

As discussed above, system 100 can implement a method for calculation of thermal performance metrics of a single unit or a fleet of units. FIG. 3 illustrates a flow diagram of an exemplary method 300 that can be implemented in the steam turbine remote monitoring, diagnosing and benchmarking system 100. At step 305, the system 100 acquires thermal performance data from steam turbine facility 105, which can be from steam turbine raw data tables collected at local computer 110. At step 310, it is determined whether there is data available, the data being related to the thermal performance of the turbine. If there is no data available, an error message can be generated at step 315. The error message can be displayed on local computer 110, or the GUI on workstation 130. It is understood that the error message can be propagated in a variety of ways. At step 320, it is determined whether or not the data is valid, assuming that data is available at step 310. If the data is not valid, an error message can be generated at step 315. If the data is valid at step 320, at step 325, the data can be segmented. For example, the data can be segmented according to the day it was collected. The data can further be segmented into whether the data is transient, collected from turbine startup, turbine roll-down, etc.

At step 330, the operating mode of the steam turbine is determined. In general, the operating mode can have specific operation definitions at 331, which can be stored in the steam turbine database 140, for example. At step 335, temperature statistics can be calculated. The temperature statistics can include any variety of calculations useful in determining the thermal performance of the unit. At step 340, any over-threshold calculations can be performed, which can be based on pre-determined unit-specific thresholds defined at 341. The thresholds can be stored in steam turbine database 140.

At step 345, any calculations for starts and trips of the turbine can be performed. Similarly, any further calculations related to turbine metrics, if desired, can be performed at step 350. The calculations results can be stored at step 355, such as in steam turbine database 140. Steam turbine calculated tables can be re-stored at 356. At step 360, any design-specific filtering due to specifics of the turbine facility 105 can be performed. At step 365, benchmarking visualization can be performed, such as on the GUI on workstation 130. It is appreciated that several benchmarking factors can be evaluated such as hours of critical life exceedance of a particular turbine. Similarly, annual hours exceedance of a particular turbine can be evaluated. A unit level comparison either of a unit to itself, or to a unit of similar configuration can further be performed. In addition, a fleet level comparison can be performed, that is, a comparison of a particular unit to an entire fleet of units.

Figure 4:
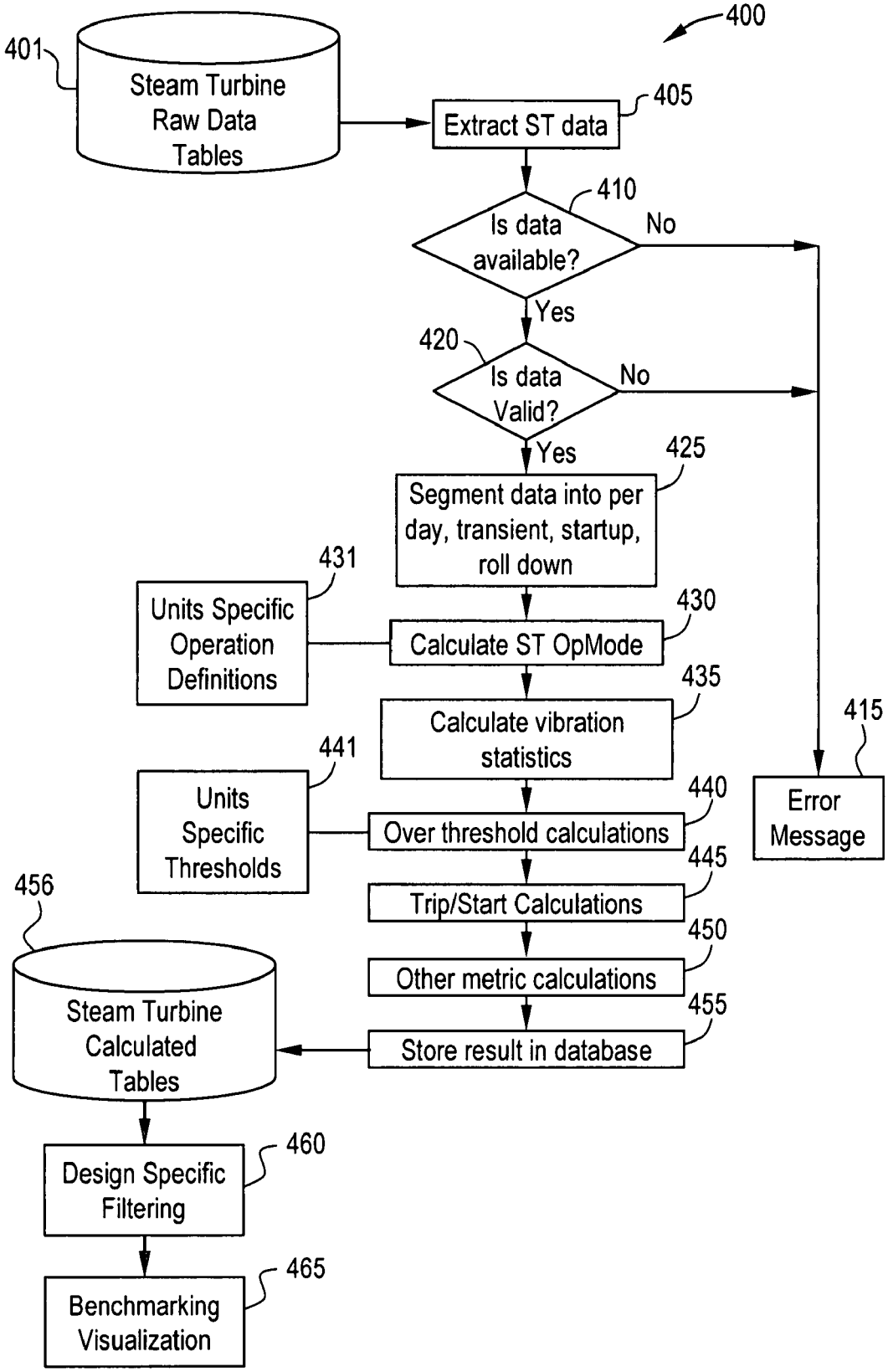
FIG. 4 illustrates a flow diagram of an exemplary vibration metrics calculation method.

Similarly, system 100 can implement a method for calculating vibration metrics of a single unit or a fleet of units. FIG. 4 illustrates a flow diagram of an exemplary method 400 that can be implemented in the steam turbine remote monitoring, diagnosing and benchmarking system 100. At step 405, the system 100 acquires vibration data from steam turbine facility 105, which can be from steam turbine raw data tables collected at local computer 110. At step 410, it is determined whether there is data available, the data being related to the vibration metrics of the turbine. If there is no data available, an error message can be generated at step 415. The error message can be displayed on local computer 110, or the GUI on workstation 130. It is understood that the error message can be propagated in a variety of ways. At step 420, it is determined whether or not the data is valid, assuming that data is available at step 410. If the data is not valid, an error message can be generated at step 415. If the data is valid at step 420, at step 425, the data can be segmented. For example, the data can be segmented according to the day it was collected. The data can further be segmented into whether the data is transient, collected from turbine startup, turbine roll-down, etc.

At step 430, the operating mode of the steam turbine is determined. In general, the operating mode can have specific operation definitions at 431, which can be stored in the steam turbine database 140, for example. Exemplary operating modes are now discussed. A Full Speed No Load (FSNL) mode is based on the breaker being open with the turbine speed (TNH)>98 RPM and the acceleration dTNH/dt<2ROM/30 sec. An Accelerate Range 1, Warm Start (Forward Flow) mode is based on TNH>10 RPM<2000 RPM and dTNH/dt>0. In addition, RF(A10) and all D11—Hot Start Determined by Reheat Bowl (Steam–Metal) Temperature (TT_RHS–TT_RHBLI and TT_RHBUI1)=400° C. to –300° C. In an exemplary implementation, the method checks logic, and CSP files for specific tags used. For Accelerate Range 1 for a warm start and forward flow, the above parameters remain the same. However, FF(A10) Hot Start Determined by First Stage (Steam–Metal) Temperature (TT_IS–TT__1SB or TT__1SBL or TT__1SBU)=400° C. to –300° C. In an exemplary implementation, the method checks for logic similar to as discussed above. For Accelerate Range 2 for a warm start, TNH>2000 RPM and dTNH/dt>0. For Accelerate Range 1 for a cold start having a reverse flow, TNH>10 RPM<2000 RPM and dTNH/dt>0. In addition, RF(A10) and all D11—Hot Start Determined by Reheat Bowl (Steam–Metal) Temperature (TT_RHS–TT_RHBLI and TT_RHBUI1)=600° C. to 400° C. In an exemplary implementation, the method checks logic, and CSP files for specific tags used. For Accelerate Range 1 for a cold start and reverse flow, FF(A10) Hot Start Determined by First Stage (Steam–Metal) Temperature (TT_IS–TT__1SB or TT__1SBL or TT__1SBU)=600° C. to 400° C. In an exemplary implementation, the method checks for logic similar to as discussed above. For Accelerate Range 2, for a cold start, TNH>2000 RPM and dTNH/dt>0. Several other operation modes are also contemplated. In a loaded mode, a L52GX (Generator Breaker)="1" indicating that the breaker is closed. In addition DWATT>0. In a rated load mode, V1_POS and V1L_POS (Control Valve Position) between 85% and 100%, and DWATT>85% nameplate rating. For a decelerate mode, TNH<96% and the L52GX (Generator Breaker)="0", indicating that it is open, and dTNH/dt<0. In addition, a generic off/unknown mode can indicate a non-recognized mode.

Referring still to FIG. 4, at step 435, vibration statistics can be calculated. The vibration statistics can include any variety of calculations useful in determining the vibration metrics of the unit. At step 440, any over-threshold calculations can be performed, which can be based on pre-determined unit-specific thresholds defined at 441. The thresholds can be stored in steam turbine database 140.

At step 445, any calculations for starts and trips of the turbine can be performed. Similarly, any further calculations related to turbine metrics, if desired, can be performed at step 450. The calculations results can be stored at step 455, such as in steam turbine database 140. Steam turbine calculated tables can be re-stored at 356. At step 460, any design-specific filtering due to specifics of the turbine facility 105 can be performed. At step 465, benchmarking visualization can be performed, such as on the GUI on workstation 130. It is appreciated that several benchmarking factors can be evaluated such as transient vibrations and accelerate ranges of a particular turbine. A unit level comparison either of a unit to itself, or to a unit of similar configuration can further be performed. In addition, a fleet level comparison can be performed, that is, a comparison of a particular unit to an entire fleet of units.

Figure 5:
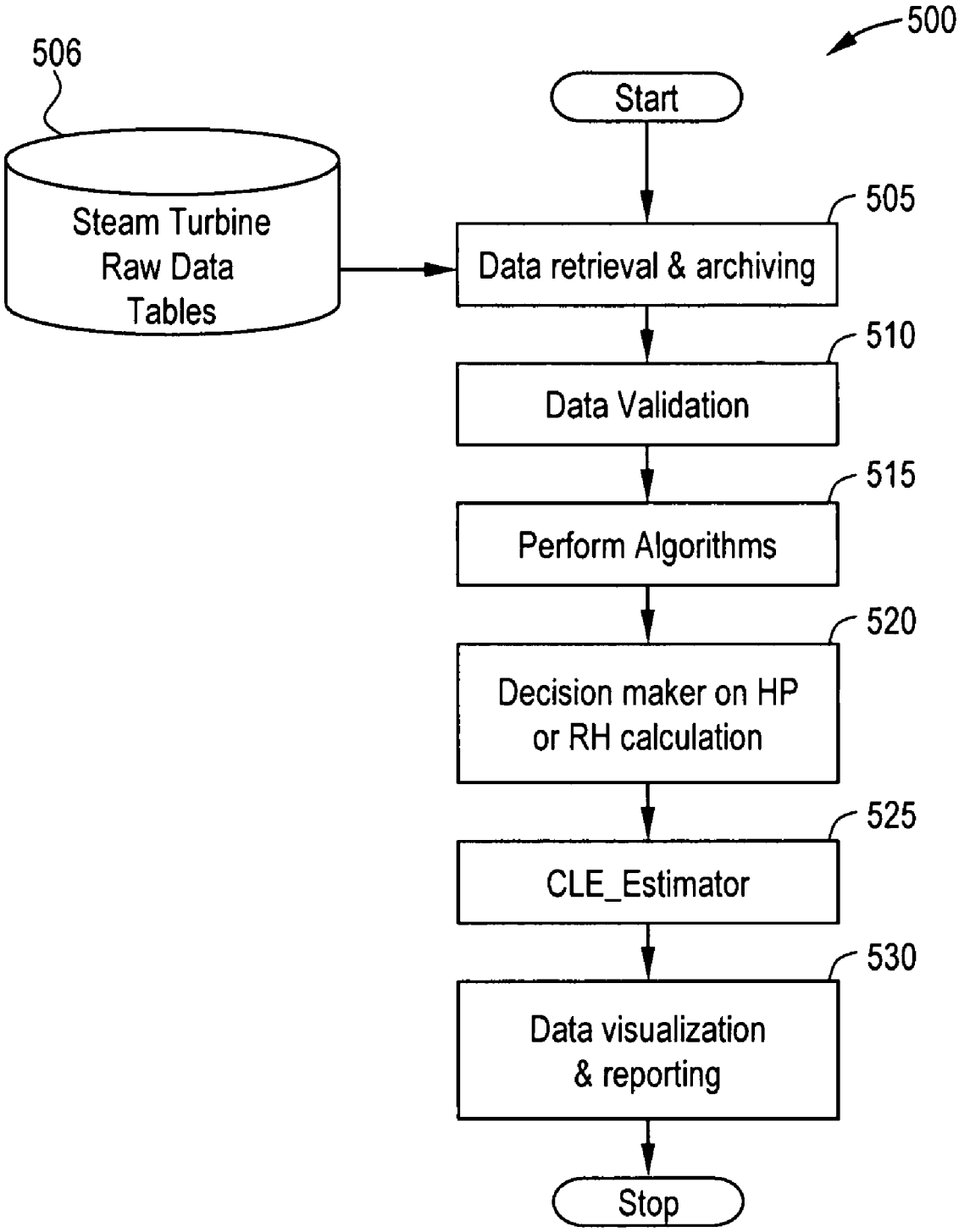
FIG. 5 illustrates a flow diagram of an exemplary expended life calculation method.

System 100 can implement a method for calculating expended of a single unit or a fleet of units. FIG. 5 illustrates a flow diagram of an exemplary method 500 that can be implemented in the steam turbine remote monitoring, diagnosing and benchmarking system 100. At step 505, the system 100 acquires data from steam turbine facility 105. Data can also be gathered at 506 from steam turbine database 140. At step 510, the data is validated and optionally filtered. In general, the data is also checked for accuracy. At step 515 algorithms, such as start-up algorithms are performed. For example, one algorithm that is used determines the sensors that are used, including the rotor speed and bowl metal temperatures. Cycle life expended (CLE) is the rotor life expended index. CLE is estimated based on the number of thermal cycles a rotor has undergone during the turbine startup and shutdown cycle. A CLE calculation can be performed which estimates the temperature difference at start-up versus operational temperatures. An actual ramp rate of the temperature can further be calculated. In addition, back calculations of an actual CLE curve can be calculated. A life estimation calculation can be performed. The values can be accumulated and remaining life (expected number of cycles minus actual life accumulated) can be calculated. It is appreciated that several factors in the determination of remaining life can be taken into account, including, but not limited to: stage metal temperature changes, ramp rate, high pressure cyclic life curves, operating temperatures, etc.

Based on the design, the turbine either starts at High Pressure (HP) section or the ReHeat (RH) section. Hence, the startup CLE expended is calculated based on which section of turbine has started first. Rules exist to identify which of those two sections started first. At step 520, a decision maker on HP or RH can be calculated. At step 525 a CLE estimator can be implemented. In general, a current start of estimated CLE indicates whether or not the turbine is within an allowable limit or in a critical life expenditure state. A cumulative CLE indicates the residual life or a turbine.

At step 530, data visualization and reporting can be reported, such as at workstation 130.

Figure 6:
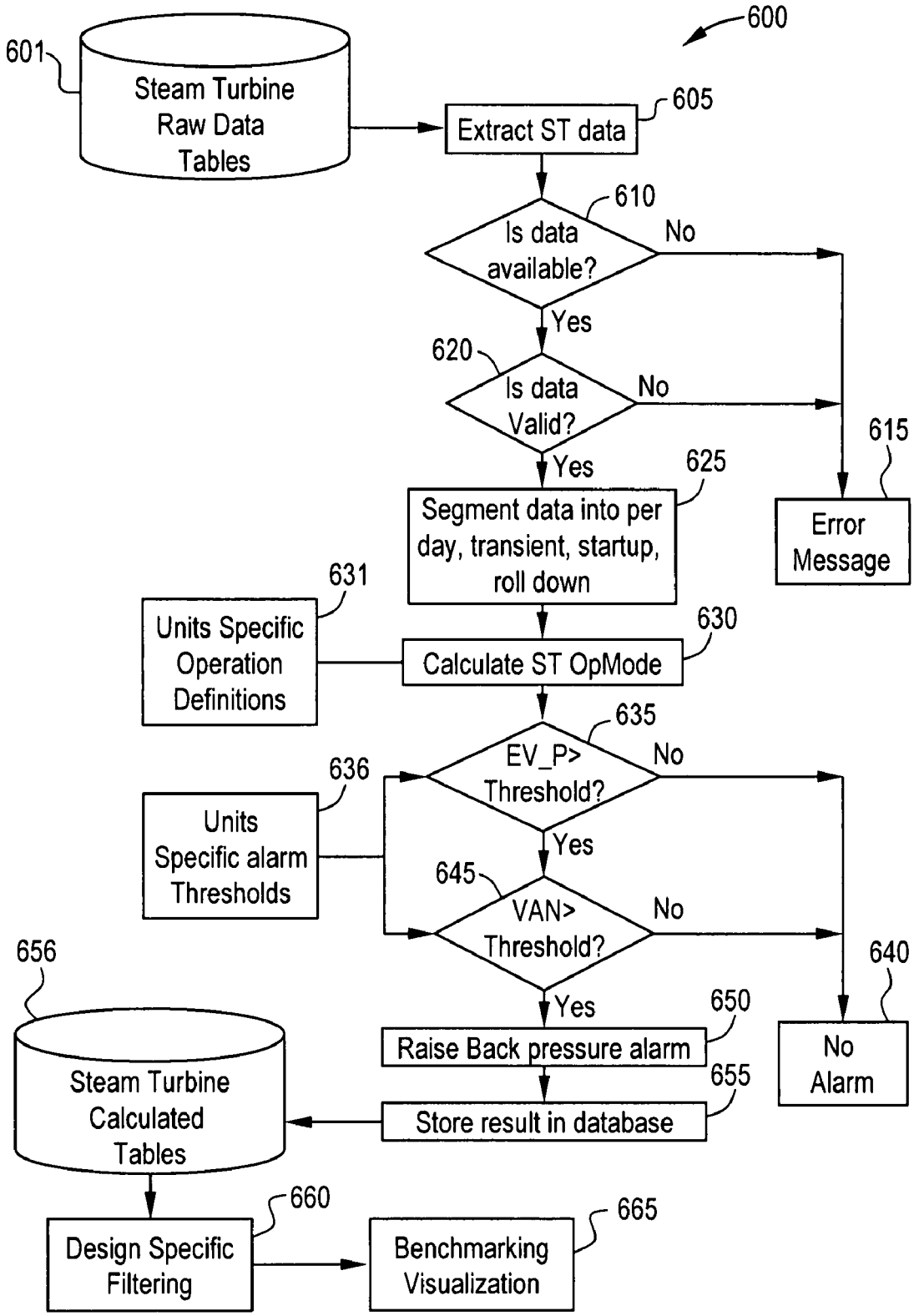
FIG. 6 illustrates a flow diagram of an exemplary back-pressure metrics calculation method.

System 100 can implement a method for calculating backpressure metrics of a single unit or a fleet of units. FIG. 6 illustrates a flow diagram of an exemplary method 600 that can be implemented in the steam turbine remote monitoring, diagnosing and benchmarking system 100. At step 605, the system 100 acquires backpressure metrics data from steam turbine facility 105, which can be from steam turbine raw data tables collected at local computer 110. At step 610, it is determined whether there is data available, the data being related to the backpressure metrics of the turbine. If there is no data available, an error message can be generated at step 615. The error message can be displayed on local computer 110, or the GUI on workstation 130. It is understood that the error message can be propagated in a variety of ways. At step 620, it is determined whether or not the data is valid, assuming that data is available at step 610. If the data is not valid, an error message can be generated at step 615. If the data is valid at step 620, at step 625, the data can be segmented. For example, the data can be segmented according to the day it was collected. The data can further be segmented into whether the data is transient, collected from turbine startup, turbine rolldown, etc.

At step 630, the operating mode of the steam turbine is determined. In general, the operating mode can have specific operation definitions at 631, which can be stored in the steam turbine database 140, for example. After a determination of the operating mode of the turbine, alarm thresholds at 636 are used to make determinations on whether or not to generate alarms. At step 635, it is determined whether or not an exhaust vacuum feedback threshold has been exceeded. If the exhaust vacuum feedback threshold has not been exceeded at step 625, then no alarm is triggered at step 640. If the exhaust vacuum feedback threshold has been exceeded, the at step 645, it is determined whether or not an annular velocity threshold has been exceeded. If the annular velocity threshold has not been exceeded, then no alarm is generated at step 640. If the annular velocity threshold has been exceeded, then at step 650 a back pressure alarm is raised.

The calculations results can be stored at step 655, such as in steam turbine database 140. Steam turbine calculated tables can be re-stored at 656. At step 660, any design-specific filtering due to specifics of the turbine facility 105 can be performed. At step 665, benchmarking visualization can be performed, such as on the GUI on workstation 130. It is appreciated that several benchmarking factors can be evaluated such as generator watts, HP turbine speed, etc. of a particular turbine. A unit level comparison either of a unit to itself, or to a unit of similar configuration can further be performed. In addition, a fleet level comparison can be performed, that is, a comparison of a particular unit to an entire fleet of units.

Figure 7:
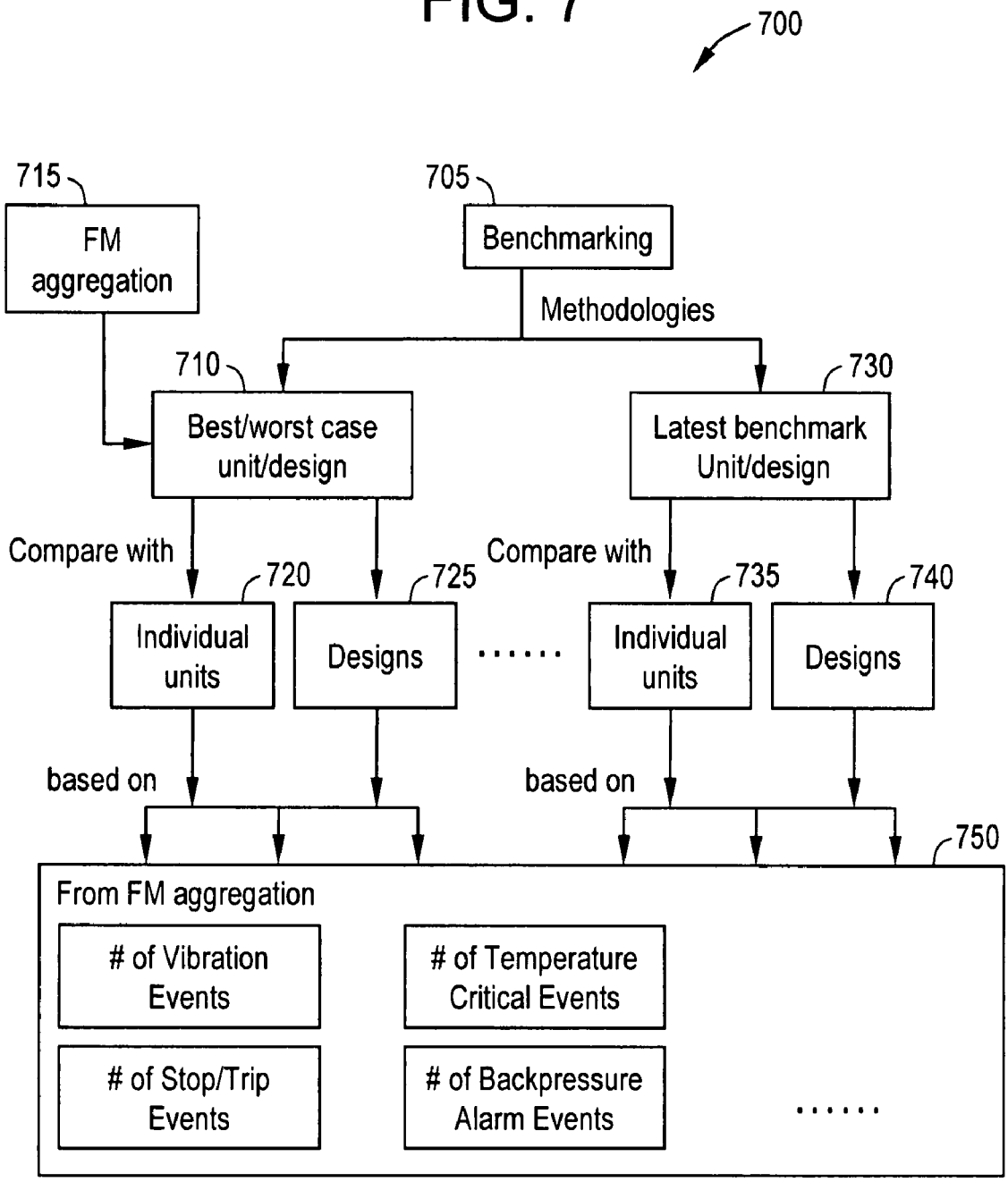
FIG. 7 illustrates a flow diagram of an exemplary steam turbine benchmarking method.

System 100 can also be implemented to monitor entire steam turbine fleet health and performance and to study steam turbine unit-to-unit and fleet-to-fleet variations. FIG. 7 illustrates a flow diagram of an exemplary method 700 that can be implemented in the steam turbine remote monitoring, diagnosing and benchmarking system 100. In general, method 700 can be implemented to determine benchmarking, that is, comparing the different turbine units with the baseline unit a baseline unit is a unit that has zero critical events/higher efficiency/less CLE spent. Alarm units are units that have less than X number of critical events. Exceptional units are units that have more than X number of critical events. The method also generally provides the capability to compare: multiple units in the same plant; multiple units in single design; various time window; one design versus another design; one customer with another customer; multiple units in single customer, etc. In general, benchmarking of a steam turbine requires comparison of various performance and health metrics of the steam turbine to a turbine of similar configuration. In an exemplary implementation, the rules and criteria described in the previous sections for calculation vibration, performance and other metrics are used. In addition, filtering criteria based on the design type of the steam turbine are also used.

At step 705, benchmarking can use different methodologies for fleet wide comparison. At step 710, a best/worst case unit/design can be determined based on FM aggregation at step 715. FM aggregation is the task of aggregating all the metrics into simple and usable statistics, as follows:

1) Comparison of performance of a steam turbine with its own past performance. Since the calculation of efficiency, temperature alarms, critical alarms, backpressure alarms, expended cycle life, vibration metrics, etc were performed under filtered and corrected conditions, the results from the above described algorithms can be used directly to compare turbines current operation with its past operation.
2) Comparison of performance of a steam turbine with turbines of same design across various customers—This allows identification of the best unit across all the customers. Identification of reasons for the good performance of the best unit could lead to selling upgrades (hardware or control) to other turbines to bring their performance up to the best one in the entire fleet.
3) Comparison of performance of a steam turbine with turbines of same design within the same customer group—This allows identification of best unit in customer fleet and worst unit in the fleet.
4) Development of a red, yellow, green status for various design types, customer fleets, customer sites, and specific units. Using the metrics calculated in the previous sections, a simple red, yellow, green status is developed based on the number, type and severity of the alarms the units have produced on a daily, weekly, monthly, quarterly and yearly basis. These aggregated reports can then be presented to customers to report the health of the units.

Comparisons can be made with individual units at step 720, designs at step 725, etc. It is appreciated that other comparisons can be made when performing benchmarking methodologies.

In general, data acquisition device 100 collects real time data of steam turbines of steam turbine facility 105, and transfers the data to central monitoring station 120 at periodic intervals, via communication medium 115. As described above, system 100 includes calculation engine process 145, which analyzes this data at a 1-minute interval to derive measures from real-time data on fleet vibration metrics, fleet lifing and usage metrics, fleet bench marking and anomaly detection. Prior to analyzing the steam turbine performance metrics, steam turbine operating modes are determined to form a basis for automatic performance issue detection. Turbine operating modes, as a platform, enable these determinations and allow other calculations to determine if the operation of the machine is correct for the given conditions. In addition, the turbine operating modes later aid to determine if the machine is being operated correctly. The operating modes are defined using certain critical parameters like turbine speed, generator output etc., to determine steady or transient conditions. This distinction is also useful while monitoring vibration and performance.

The system 100 further tracks and maintains lifing and usage metrics for all the steam turbines that are being monitored. These metrics include the number of: hours at different operating loads and load levels; hot starts; cold starts; stops/trips; hours of operation; hours of down time; hours on turning gear; hours the inlet temperature exceeded pre-defined thresholds; hours the exhaust pressure exceeded pre-defined thresholds, etc. In exemplary implementations, starts/stops/trip conditions of steam turbines are reported based on controller logic, which gives conditions of turbine reset and turbine trip. Any stop event within X minutes of the trip event shall be classified as the trip.

In another exemplary implementation, the system 100 calculates multilevel threshold alarms that are generated for vibration and temperature exceedances. The thresholds limits are generally user defined and configurable on a per turbine per measurement per operation mode basis. Unit specific allowable thresholds on vibration are based on startup and steady state operation. Benchmarking of individual units can be generated using the count of vibration exceedence, inlet temperature exceedence and number of stops/trips. Limits can be set for the above-mentioned calculated parameters such as, but not limited to: number of vibration exceedences/week; number of temperature exceedences/week; number of stops/trips/week; time taken to reach rated speed; duration of time at base load (optimal condition). System 100 can then compare the different units with the limits specified. In general, units that are very equal/close to the limits can be considered as baseline units and the other units can be compared with these baseline units. Results can be presented in bar chart or any other suitable type of presentation, which can be displayed on the GUI on workstation 130.

System 100 generally provides the following fleet metrics: performance metrics; fleet vibration metrics; fleet lifing and usage metrics; benchmarking, etc. With respect to performance metrics, system 100 provides capability to compare performance of various steam turbines. These comparisons include: comparison of the performance of multiple units in the same plant; comparison of performance of multiple units in fleet; comparison of performance of a single unit with respect to fleet performance; comparison of performance for various time windows; comparison of performance of one fleet versus another fleet; comparison of performance of one customer's unit with another; current performance of units versus a baseline, etc.

With respect to fleet vibration metrics, system 100 provides capability to aggregate vibration related events. Such aggregation can be done by: different vibration levels; turbine or group of turbines; customer; different time periods; different operation mode, etc.

With respect to fleet lifing and usage metrics, system 100 tracks and maintains lifing and usage metrics for all the steam turbines that are being monitored. These metrics include the number of: hot starts; cold starts; stops/trips; hours of operation; hours of down time; hours on turning gear; hours the inlet temperature exceeded pre-defined thresholds; hours the exhaust pressure exceeded pre-defined thresholds; hours at different load levels; hours at different operating modes, etc.

With respect to benchmarking, system 100 provides capability to do comparative analyses by benchmarking, which refers to comparing a particular unit's performance against a representative sample of similar units. System 100 provides capability to compare current sensor values or calculated values against their values taken during commissioning and other special events.

In accordance with exemplary embodiments and implementation, system 100 monitors a steam turbine unit performance online and compares it with steam turbine units across particular fleet, other units in a customer plant and units of same design type. System 100 further provides a comprehensive, uniform, real-time infrastructure to collect, process and display sensor data, anomalies, trends and alarms from remote test sites, for assisting in validation of existing turbines and new steam turbine designs.

As described above, the exemplary embodiments can be in the form of computer-implemented processes and apparatuses for practicing those processes. The exemplary embodiments can also be in the form of computer program code containing instructions embodied in tangible media, such as floppy diskettes, CD ROMs, hard drives, or any other computer-readable storage medium, wherein, when the computer program code is loaded into and executed by a computer, the computer becomes an apparatus for practicing the exemplary embodiments. The exemplary embodiments can also be in the form of computer program code, for example, whether stored in a storage medium, loaded into and/or executed by a computer, or transmitted over some transmission medium, loaded into and/or executed by a computer, or transmitted over some transmission medium, such as over electrical wiring or cabling, through fiber optics, or via electromagnetic radiation, wherein, when the computer program code is loaded into an executed by a computer, the computer becomes an apparatus for practicing the exemplary embodiments. When implemented on a general-purpose microprocessor, the computer program code segments configure the microprocessor to create specific logic circuits.

This written description uses examples to disclose the invention, including the best mode, and also to enable any person skilled in the art to make and use the invention. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

The invention claimed is:

1. A turbine monitoring system, comprising:

a turbine;

a data acquisition device coupled to the turbine, the data acquisition device for collecting turbine data that includes HP efficiency parameters of the turbine; and a central monitoring system coupled to the data acquisition device, the central monitoring system for receiving the collected turbine data and processing the turbine data to determine turbine performance;

a process on the central monitoring system, the process for calculating HP efficiency of the turbine and for correcting the HP efficiency.

2. The system as claimed in claim 1 wherein the process for calculating and correcting the HP efficiency comprises instructions to correct the HP efficiency for valve position of the turbine.

3. The system as claimed in claim 1 wherein the process for calculating and correcting the HP efficiency comprises instructions to correct the HP efficiency for throttle temperature of the turbine.

4. The method as claimed in claim 1 wherein the process further includes instructions to apply analyzed data to the turbine to correct performance of the turbine, including applying of data validity and stability rules, tracking patterns and features of the turbine data, confirming the patterns and features of the turbine data against known features of the turbine and improving turbine performance by applying the confirmed patterns and features of the turbine data.

5. A turbine monitoring system, comprising:

a turbine;

a data acquisition device coupled to the turbine, the data acquisition device for collecting turbine data that includes thermal performance parameters of the turbine; and a central monitoring system coupled to the data acquisition device, the central monitoring system for receiving the collected turbine data and processing the turbine data to determine turbine performance;

a process on the central monitoring system, the process for calculating thermal performance metrics of the turbine and for providing corrections to the thermal performance metrics.

6. The system as claimed in claim 5 wherein the process further includes instructions to apply analyzed data to the turbine to alter performance of the turbine, including tracking patterns and features of the turbine data, confirming the patterns and features of the turbine data against known features of the turbine and improving turbine performance by applying the confirmed patterns and features of the turbine data.

7. The system as claimed in claim 5 further comprising a second process on the central monitoring system to collect and perform calculations on data related to thermal performance of a turbine fleet and at least one additional turbine with the turbine from predetermined time periods, the turbine and the additional turbine being members of the fleet.

8. The system as claimed in claim 7 wherein the second process includes instructions to compare metrics of at least one turbine with at least one of fleet level thermal performance and one turbine of the fleet with another turbine of the fleet of a similar configuration.

9. A turbine monitoring system, comprising:

a turbine;

a data acquisition device coupled to the turbine, the data acquisition device for collecting turbine data that includes vibration metrics parameters of the turbine; and a central monitoring system coupled to the data acquisition device, the central monitoring system for receiving the collected turbine data and processing the turbine data to determine turbine performance;

a process on the central monitoring system, the process for calculating vibration metrics of the turbine and including instructions to:

calculate operation modes of the turbine;

calculate vibration statistics for a given operating mode;

compare the vibration statistics to a threshold; and filter vibration statistic data based on design specifics of the turbine.

10. The system as claimed in claim 9 wherein the process further includes instructions to apply analyzed data to the turbine to alter performance of the turbine, including tracking patterns and features of the turbine data, confirming the patterns and features of the turbine data against known features of the turbine and improving turbine performance by applying the confirmed patterns and features of the turbine data.

11. The system as claimed in claim 9 further comprising a second process on the central monitoring system to collect and perform calculations on data related to vibration metrics of a turbine fleet and at least one additional turbine with the turbine from predetermined time periods, the turbine and the additional turbine being members of the fleet.

12. The system as claimed in claim 11 wherein the second process includes instructions to compare vibration metrics of at least one turbine with at least one of fleet level vibration metrics and one turbine of the fleet with another turbine of the fleet of a similar configuration.

13. A turbine monitoring system, comprising:

a turbine;

a data acquisition device coupled to the turbine, the data acquisition device for collecting turbine data that includes expended life parameters of the turbine; and a central monitoring system coupled to the data acquisition device, the central monitoring system for receiving the collected turbine data and processing the turbine data to determine turbine performance;

a process on the central monitoring system, the process for calculating expended life estimations of the turbine and including instructions to:

apply algorithms related to cycle life expended specifics of the turbine; and apply a cycle life expended estimator based on the results of the algorithms to determine that the turbine is within an allowable limit of operation.

14. The system as claimed in claim 13 wherein the process further includes instructions to apply analyzed data to the turbine to alter performance of the turbine, including tracking patterns and features of the turbine data, confirming the patterns and features of the turbine data against known features of the turbine and improving turbine performance by applying the confirmed patterns and features of the turbine data.

15. A turbine monitoring system, comprising:

a turbine;

a data acquisition device coupled to the turbine, the data acquisition device for collecting turbine data that includes backpressure metrics parameters of the turbine; and a central monitoring system coupled to the data acquisition device, the central monitoring system for receiving the collected turbine data and processing the turbine data to determine turbine performance;

a process on the central monitoring system, the process for calculating backpressure metrics of the turbine and having instructions to:

calculate operation modes of the turbine;

calculate back pressure statistics for a given operating mode;

compare the back pressure statistics to a threshold; and filter back pressure statistic data based on design specifics of the turbine.

16. The system as claimed in claim 15 wherein the process further includes instructions to apply analyzed data to the turbine to alter performance of the turbine, including tracking patterns and features of the turbine data, confirming the patterns and features of the turbine data against known features of the turbine and improving turbine performance by applying the confirmed patterns and features of the turbine data.

17. A turbine monitoring system, comprising:

a turbine;

a data acquisition device coupled to the turbine, the data acquisition device for collecting turbine data that includes critical performance metrics parameters of the turbine; and a central monitoring system coupled to the data acquisition device, the central monitoring system for receiving the collected turbine data and processing the turbine data to determine turbine performance;

a process on the central monitoring system, the process for calculating critical performance metrics of the turbine.

18. The system as claimed in claim 17 wherein the process further includes instructions to apply analyzed data to the turbine to alter performance of the turbine, including tracking patterns and features of the turbine data, confirming the patterns and features of the turbine data against known features of the turbine and improving turbine performance by applying the confirmed patterns and features of the turbine data.

19. The system as claimed in claim 18 wherein the process includes instructions to compare the critical performance metrics within the turbine.

20. The system as claimed in claim 18 wherein the process includes instructions to compare the critical performance parameters with a fleet level signature to benchmark the performance of at least one of an additional turbine and the fleet.

21. The system as claimed in claim 18 further comprising a calculation engine process residing on the central monitoring system, the calculation engine process for turbine data analysis.

22. The system as claimed in claim 21 wherein the calculation engine process further derives measures from the turbine data on at least one of: HP efficiency, corrected HP efficiency, thermal performance metrics, vibration metrics, backpressure metrics, expended life estimations, fleet lifing and usage metrics, fleet benchmarking, and anomaly detection.

23. The system as claimed in claim 18 further comprising a communication medium disposed between the data acquisition device and the central monitoring station.

24. The system as claimed in claim 23 wherein the central monitoring system comprises a server coupled to the communication medium, the server having processes for analyzing the turbine data.

25. The system as claimed in claim 18 wherein the processes include a process for real-time on-line collection and analysis of the turbine data for comparison turbine data of at least one additional turbine.

26. The system as claimed in claim 18 further comprising a data retrieval and archiving process for retrieving the acquired data, organizing file structure and archiving the acquired data.

27. The system as claimed in claim 18 further comprising a diagnostic assessment process for testing performance and health of the turbine.

28. The system as claimed in claim 18 further comprising a data visualization and reporting process for presenting the processed data on a graphical user interface residing in the central monitoring system.

29. A turbine performance measurement method, comprising:

acquiring data real-time from a turbine;

transmitting the data at periodic intervals for analysis;

analyzing the transmitted data for operating parameters; and applying the analyzed data to the turbine to alter performance of the turbine.

30. The method as claimed in claim 29 further comprising validating the collected data prior to transmission of the data.

31. The method as claimed in claim 29 wherein analyzing the transmitted data for operating parameters comprises:

calculating HP efficiency of the turbine;

correcting the HP efficiency for a valve position of the turbine;

correcting the HP efficiency for throttle temperature of the turbine; and calculating a corrected HP efficiency based on the corrections for the valve position and the throttle temperature.

32. The method as claimed in claim 29 wherein applying the analyzed data to the turbine to alter performance of the turbine, comprises:

tracking patterns and features of the turbine data;

confirming the patterns and features of the turbine data against known features of the turbine; and improving turbine performance by applying the confirmed patterns and features of the turbine data.

33. The method as claimed in claim 29 further comprising determining turbine operating modes for a performance basis of the turbine.

34. The method as claimed in claim 29 wherein analyzing the transmitted data for operating parameters comprises deriving measures from the acquired data on at least one of: HP efficiency, corrected HP efficiency, thermal performance metrics, vibration metrics, backpressure metrics, expended life estimations, fleet lifing and usage metrics, fleet benchmarking, and anomaly detection.

* * * * *